US007748212B2

(12) United States Patent
Sedlacek et al.

(10) Patent No.: US 7,748,212 B2
(45) Date of Patent: Jul. 6, 2010

(54) EXHAUST AFTERTREATMENT SYSTEM WITH FLOW DISTRIBUTION

(75) Inventors: Jeffrey T. Sedlacek, Stoughton, WI (US); Jay V. Warner, Stoughton, WI (US)

(73) Assignee: Cummins Filtration IP, Inc., Minneapolis, MN (US)

( * ) Notice: Subject to any disclaimer, the term of this patent is extended or adjusted under 35 U.S.C. 154(b) by 51 days.

(21) Appl. No.: 11/684,118

(22) Filed: Mar. 9, 2007

(65) Prior Publication Data

US 2008/0216470 A1 Sep. 11, 2008

(51) Int. Cl.
*F01N 3/00* (2006.01)

(52) U.S. Cl. ..... 60/286; 60/274; 60/301; 60/324

(58) Field of Classification Search ..... 60/274, 60/286, 299, 301, 303, 324
See application file for complete search history.

(56) References Cited

U.S. PATENT DOCUMENTS

| | | | | |
|---|---|---|---|---|
| 4,011,922 | A | 3/1977 | Goplen | |
| 4,209,493 | A | 6/1980 | Olson | |
| 5,426,269 | A | 6/1995 | Wagner et al. | |
| 6,449,947 | B1 | 9/2002 | Liu et al. | |
| 6,601,385 | B2 | 8/2003 | Verdegan et al. | |
| 6,712,889 | B2 | 3/2004 | Pillion et al. | |
| 6,722,123 | B2 * | 4/2004 | Liu et al. | 60/286 |
| 6,767,378 | B2 * | 7/2004 | Nishiyama et al. | 55/309 |
| 7,328,572 | B2 * | 2/2008 | McKinley et al. | 60/286 |
| 2003/0079467 | A1 | 5/2003 | Liu et al. | |

FOREIGN PATENT DOCUMENTS

| | | |
|---|---|---|
| JP | 1993/288047 | 11/1993 |
| WO | WO-96/12877 | 5/1996 |

* cited by examiner

*Primary Examiner*—Thomas E Denion
*Assistant Examiner*—Diem Tran
(74) *Attorney, Agent, or Firm*—Andrus, Sceales, Starke & Sawall, LLP; J. Bruce Schelkopf

(57) ABSTRACT

An exhaust aftertreatment system has a side inlet flow diffuser and provides even flow exhaust distribution to an aftertreatment element.

5 Claims, 3 Drawing Sheets

EXHAUST AFTERTREATMENT SYSTEM WITH FLOW DISTRIBUTION

BACKGROUND AND SUMMARY

The invention relates to aftertreatment systems for internal combustion engine exhaust, and more particularly to flow distribution.

To address engine emission concerns, new standards continue to be proposed for substantial reduction of various emissions, including NOx and particulate emissions. Increasingly stringent standards will require installation of aftertreatment devices in engine exhaust systems. Some of the aftertreatment technologies require certain chemical species to be injected into the exhaust system. For example, HC or fuel is injected in some active lean NOx systems for NOx reduction, or in active diesel particulate filters (DPF) for regeneration to take place (oxidizing the soot and cleaning the filter), and urea solution is injected in selective catalytic reduction (SCR) systems for NOx reduction. These injected chemical species need to be well mixed with exhaust gas and evenly distributed before reaching catalysts or filters for the systems to perform properly.

The present invention arose during continuing development efforts directed toward the above exhaust aftertreatment systems.

DETAILED DESCRIPTION

Figure 1:
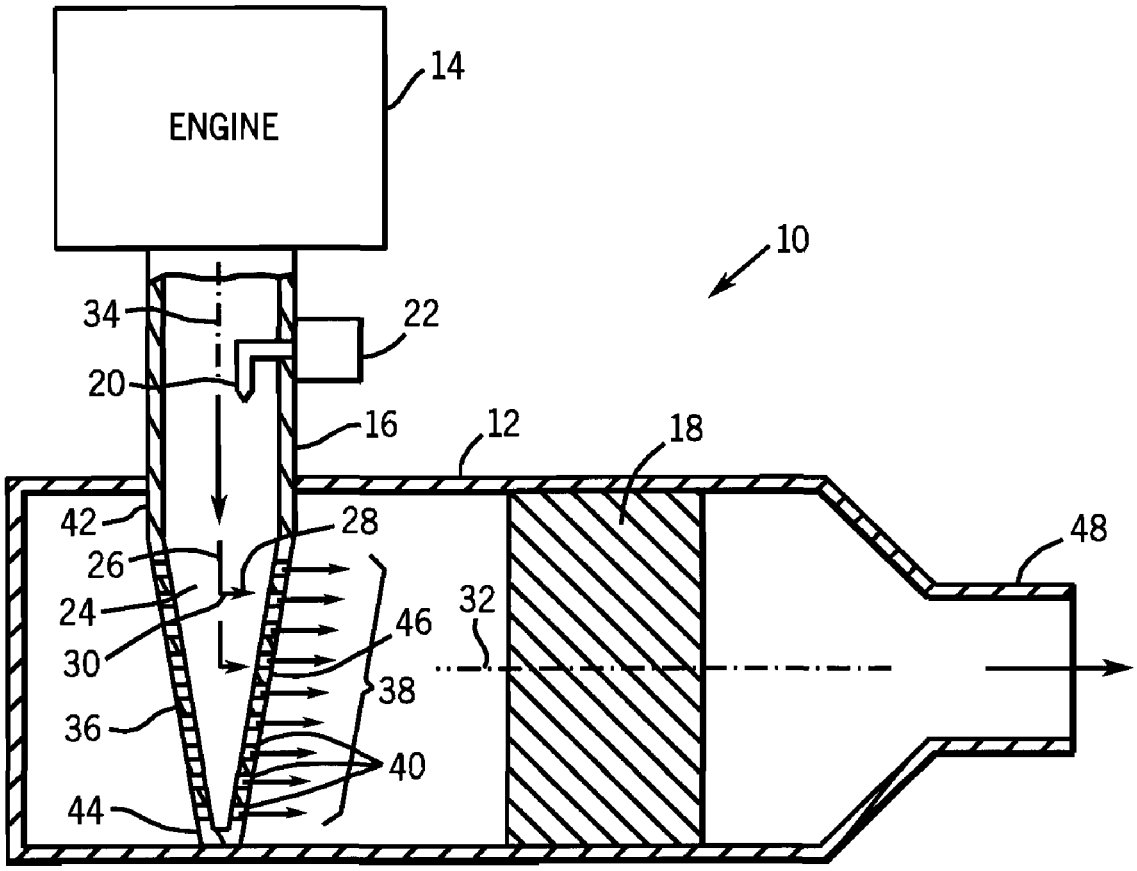
FIG. 1 is a side schematic sectional view of an exhaust aftertreatment system in accordance with the invention.

FIG. 1 shows an exhaust aftertreatment system 10 including an exhaust conduit or pipe 12 carrying internal combustion engine exhaust from engine 14 and side inlet 16 to an exhaust aftertreatment element 18 treating the exhaust, for example a selective catalytic reduction (SCR) catalyst and/or an oxidation catalyst (e.g. a diesel oxidation catalyst DOC). An injector 20 is provided upstream of aftertreatment element 18 and injects chemical species mixing with the exhaust prior to reaching aftertreatment element 18. For example, in one embodiment aqueous urea solution is injected from reservoir or tank 22. The exhaust conduit has an L-shaped bend at 24 for the exhaust flow path, including first and second legs 26 and 28 meeting at an L-shaped junction 30. Second leg 28 extends axially along an axis 32 along an axial direction and directing exhaust to aftertreatment element 18. First leg 26 extends laterally along a lateral direction 34 relative to axis 32 and directs exhaust to second leg 28. A flow distributor 36 is provided at the noted L-shaped junction and distributes exhaust flow from first leg 26 to second leg 28 in an evenly distributed flow pattern 38 to flow axially along second leg 28 to aftertreatment element 18.

In the preferred embodiment, flow distributor 36 is a perforated member receiving exhaust flowing laterally along first leg 26, and discharging the exhaust axially along second leg 28 through perforations 40. Flow distributor 36 has an inlet end 42 receiving exhaust flowing laterally thereinto, and has a distal end 44 laterally distally oppositely spaced from inlet end 42. Flow distributor 36 has a cross-sectional flow area which decreases as exhaust flows from inlet end 42 toward distal end 44. Inlet end 42 of flow distributor 36 has a first cross-sectional area lying in a first plane which extends along an axial direction and along a transverse direction, the transverse direction extending into the page of FIG. 1, the transverse direction being normal to axial direction 32 and normal to lateral direction 34. Flow distributor 36 has a second cross-sectional area lying in a second plane which extends along axial direction 32 and along the noted transverse direction into the page of FIG. 1. The noted second plane is laterally spaced from the noted first plane. The noted second cross-sectional area is less than the noted first cross-sectional area. Flow distributor 36 is tapered along a perforated sidewall 46 extending obliquely relative to each of the noted axial and lateral directions 32 and 34, respectively. In the preferred embodiment, flow distributor 36 is a conically shaped diffuser tube pointing laterally away from inlet end 42, and L-shaped bend 24 is 90°.

Exhaust conduit or housing 12 extends axially along the noted axis 32 and has an upstream inlet at 16 for receiving exhaust from engine 14, and has a downstream outlet at 48 for discharging exhaust. Inlet 16 is a side inlet receiving exhaust flowing laterally into housing 12 relative to axis 32. Aftertreatment element 18 in the housing passes exhaust axially therethrough then to outlet 48. Flow distributor 36 receives exhaust flowing laterally from inlet 16 and re-distributes the exhaust to flow axially to aftertreatment element 18 in an evenly distributed flow pattern 38. As noted, flow distributor 36 is preferably a conically shaped diffuser tube pointing downstream laterally away from the inlet, and preferably includes a perforated sidewall which conically convergingly tapers as it extends laterally away from the inlet.

Figure 2:
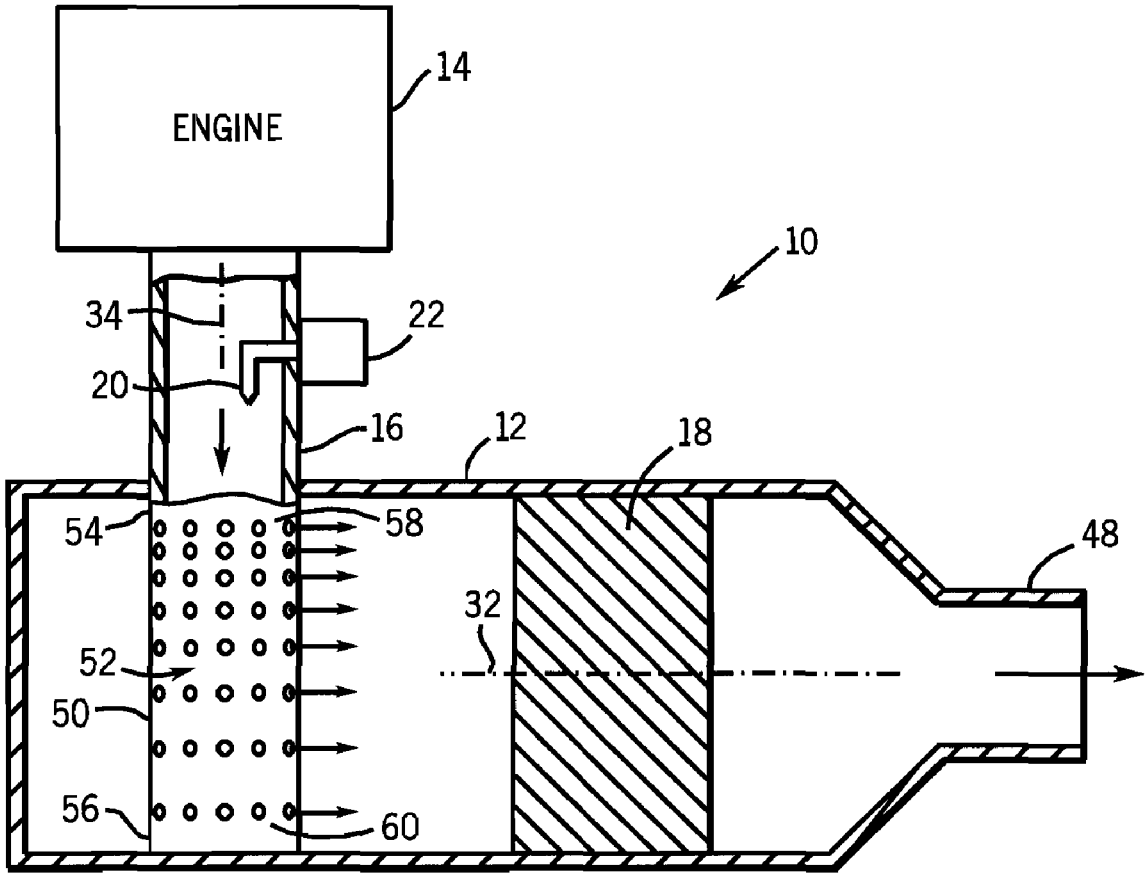
FIG. 2 is similar to FIG. 1 and shows an alternate embodiment.
Figure 3:
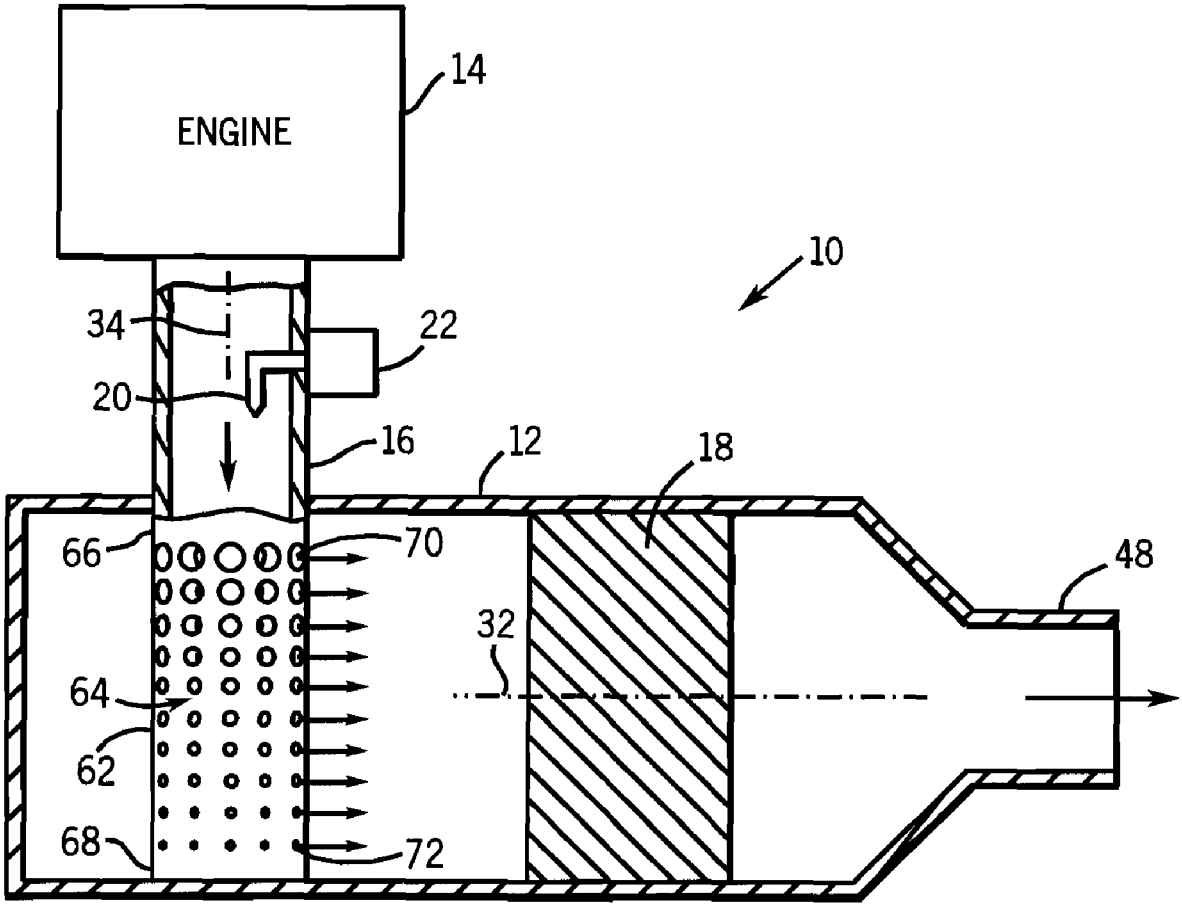
FIG. 3 is like FIG. 2 and shows another alternate embodiment.

FIGS. 2 and 3 show alternate embodiments and use like reference numerals from above where appropriate to facilitate understanding.

In FIG. 2, flow distributor 50 is shown in elevation and is a perforated member having a variable perforation pattern 52. Flow distributor 50 has an inlet end 54 receiving exhaust flowing laterally thereinto along the noted lateral direction 34, and has a distal end 56 laterally distally oppositely spaced from inlet end 54. Variable perforation pattern 52 provides a diffuser outlet flow area which decreases as exhaust flows from inlet end 54 toward distal end 56. In FIG. 2, the variable perforation pattern 52 is provided by decreasing density of perforations from inlet end 54 toward distal end 56, for example as shown at high density perforation area 58, and low density perforation area 60.

In FIG. 3, flow distributor 62 is shown in elevation and is a perforated member having a variable perforation pattern 64. Flow distributor 62 has an inlet end 66 receiving exhaust flowing laterally thereinto along the noted lateral direction 34, and has a distal end 68 laterally distally oppositely spaced from inlet end 66. Variable perforation pattern 64 provides a diffuser outlet flow area which decreases as exhaust flows from inlet end 66 toward distal end 68. In FIG. 3, variable perforation pattern 64 is provided by decreasing size of perforations from inlet end 66 toward distal end 68, for example as shown at larger size perforations 70, and smaller size perforations 72. Perforated diffuser tubes 50, 62 have variable perforation patterns 52, 64 providing a diffuser outlet flow area which decreases as exhaust flows laterally away from inlet 16.

The system provides a method for optimizing exhaust flow distribution to an aftertreatment element such as 18 in a side inlet configuration by providing a conically shaped diffuser tube 36 pointing downstream laterally away from inlet 16 and providing the diffuser tube with a perforated sidewall 46 which conically convergingly tapers as it extends laterally away from inlet 16, the method further comprising optimizing even exhaust flow distribution by adjusting the cone angle of the conically shaped diffuser tube 36 to optimize and achieve even flow distribution of exhaust flowing axially along axial direction 32 to aftertreatment element 18.

The system further provides a method for optimizing exhaust flow distribution to an aftertreatment element such as 18 in a side inlet configuration by providing a diffuser tube 50, 62 extending downstream laterally away from inlet 16, providing the diffuser tube 50, 62 with a variable perforation pattern 52, 64 providing a diffuser outlet flow area which decreases as exhaust flows laterally away from inlet 16, the method further comprising optimizing even exhaust flow distribution by decreasing at least one of density 58, 60 and size 70, 72 of perforations of the variable perforation pattern 52, 64 as the diffuser tube 50, 62 extends laterally away from inlet 16, to optimize and achieve even flow distribution of exhaust flowing axially along axial direction 32 to aftertreatment element 18.

In the foregoing description, certain terms have been used for brevity, clearness, and understanding. No unnecessary limitations are to be implied therefrom beyond the requirement of the prior art because such terms are used for descriptive purposes and are intended to be broadly construed. The different configurations, systems, and method steps described herein may be used alone or in combination with other configurations, systems, and method steps. It is to be expected that various equivalents, alternatives and modifications are possible within the scope of the appended claims.

What is claimed is:

1. An exhaust aftertreatment system comprising an exhaust conduit carrying exhaust to an aftertreatment element treating said exhaust, said conduit comprising an L-shaped bend having first and second legs meeting at an L-shaped junction, said second leg extending axially along an axis along an axial direction and directing exhaust to said aftertreatment element, said first leg extending laterally along a lateral direction relative to said axis and directing exhaust to said second leg, a flow distributor at said L-shaped junction and re-distributing exhaust to flow from said first leg to said second leg in an evenly distributed flow pattern to flow axially along said second leg to said aftertreatment element, wherein said flow distributor is a perforated member receiving exhaust flowing laterally from said first leg, and discharging said exhaust axially along said second leg, wherein said flow distributor has an inlet end receiving exhaust flowing laterally thereinto, and a distal end laterally distally oppositely spaced from said inlet end, said flow distributor having a cross-sectional flow area which decreases as exhaust flows from said inlet end toward said distal end, wherein:

said flow distributor has a first cross-sectional area at said inlet end lying in a first plane which extends along said axial direction and along a transverse direction, said transverse direction being normal to said axial direction and normal to said lateral direction;

said flow distributor has a second cross-sectional area at a point between said inlet end and said distal end, said second cross-sectional area lying in a second plane which extends along said axial direction and along said transverse direction;

said second plane is laterally spaced from said first plane;

said second cross-sectional area is less than said first cross-sectional area;

said flow distributor is tapered along a perforated sidewall extending obliquely relative to each of said axial and lateral directions.

2. The exhaust aftertreatment system according to claim 1 wherein said conduit has an inlet at said first leg, and said flow distributor is a conically shaped diffuser pointing laterally away from said inlet.

3. An exhaust aftertreatment device comprising a housing extending axially along an axis and having an upstream inlet for receiving exhaust and having a downstream outlet for discharging exhaust, said inlet being a side inlet receiving exhaust flowing laterally into said housing relative to said axis, an aftertreatment element in said housing passing exhaust axially therethrough then to said outlet, a flow distributor receiving exhaust flow laterally from said inlet and re-distributing exhaust to flow axially to said aftertreatment element in an evenly distributed flow pattern, wherein said flow distributor comprises a conically shaped diffuser tube pointing downstream laterally away from said inlet.

4. The exhaust aftertreatment device according to claim 3 wherein said diffuser tube comprises a perforated sidewall which conically convergingly tapers as it extends laterally away from said inlet.

5. A method for optimizing exhaust flow distribution to an aftertreatment element in an exhaust aftertreatment device comprising a housing extending axially along an axis and having an upstream inlet for receiving exhaust and having a downstream outlet for discharging exhaust, said inlet being a side inlet receiving exhaust flowing laterally into said housing relative to said axis, and an aftertreatment element in said housing passing exhaust axially therethrough then to said outlet, said method comprising providing a conically shaped diffuser tube pointing downstream laterally away from said inlet and providing said diffuser tube with a perforated sidewall which conically convergingly tapers as it extends laterally away from said inlet, said method further comprising optimizing even exhaust flow distribution by adjusting the cone angle of said conically shaped diffuser tube to optimize and achieve even flow distribution of exhaust flowing axially to said aftertreatment element.

* * * * *